US008442254B2

(12) United States Patent
Yu et al.

(10) Patent No.: US 8,442,254 B2
(45) Date of Patent: May 14, 2013

(54) AUDIO PORT CONFIGURATION FOR COMPACT ELECTRONIC DEVICES

(75) Inventors: Michelle Yu, Oakland, CA (US); Richard Hung Minh Dinh, Cupertino, CA (US); Tang Yew Tan, San Francisco, CA (US); Shaohai Chen, Cupertino, CA (US)

(73) Assignee: Apple Inc., Cupertiono, CA (US)

( * ) Notice: Subject to any disclaimer, the term of this patent is extended or adjusted under 35 U.S.C. 154(b) by 310 days.

(21) Appl. No.: 12/794,561

(22) Filed: Jun. 4, 2010

(65) Prior Publication Data

US 2011/0255726 A1 Oct. 20, 2011

Related U.S. Application Data

(60) Provisional application No. 61/325,803, filed on Apr. 19, 2010.

(51) Int. Cl.
*H04R 1/02* (2006.01)

(52) U.S. Cl.
USPC ..... 381/334; 381/87; 381/335; 381/91; 381/337

(58) Field of Classification Search ..... 381/87, 381/334, 335, 91, 337, 345
See application file for complete search history.

(56) References Cited

U.S. PATENT DOCUMENTS

| | | | | |
|---|---|---|---|---|
| 6,321,070 | B1 | 11/2001 | Clark et al. | |
| 6,811,431 | B2 * | 11/2004 | Hsieh | 439/495 |
| 7,869,839 | B2 * | 1/2011 | Jung | 455/575.1 |
| 8,055,003 | B2 * | 11/2011 | Mittleman et al. | 381/345 |
| 8,189,848 | B2 * | 5/2012 | Lim | 381/386 |
| 8,229,153 | B2 * | 7/2012 | Mittleman et al. | 381/361 |
| 2004/0082211 | A1 * | 4/2004 | Hsieh | 439/329 |
| 2006/0094378 | A1 | 5/2006 | Murrary et al. | |
| 2006/0153417 | A1 | 7/2006 | Furuya | |
| 2006/0188126 | A1 | 8/2006 | Andersen et al. | |
| 2007/0253591 | A1 * | 11/2007 | Popilek et al. | 381/388 |
| 2008/0149417 | A1 | 6/2008 | Dinh et al. | |
| 2008/0298628 | A1 * | 12/2008 | Lim | 381/386 |
| 2009/0097687 | A1 * | 4/2009 | Collins | 381/369 |
| 2009/0245564 | A1 * | 10/2009 | Mittleman et al. | 381/361 |
| 2010/0288331 | A1 * | 11/2010 | Weibezahn | 136/246 |
| 2011/0014733 | A1 * | 1/2011 | Wang et al. | 438/27 |
| 2011/0206316 | A1 * | 8/2011 | Wang et al. | 385/14 |

(Continued)

FOREIGN PATENT DOCUMENTS

| | | |
|---|---|---|
| DE | 11 47 983 B | 5/1963 |
| DE | 20 2004 011510 | 12/2004 |
| EP | 1 686 834 A1 | 8/2006 |

*Primary Examiner* — David S. Warren
(74) *Attorney, Agent, or Firm* — Dorsey & Whitney LLP

(57) ABSTRACT

A portable electronic device that provides compact configurations for audio elements are disclosed. The audio elements can be drivers (e.g., speakers) or receivers (e.g., microphones). In one embodiment, an audio element can be mounted on or coupled to an intermediate structure (e.g., a flexible electrical substrate) having an opening therein to allow audio sound to pass there through. In another embodiment, an audio chamber can be formed to assist in directing audio sound between an opening an outer housing and a flexible electronic substrate to which the audio element is mounted or coupled thereto. In still another embodiment, a barrier, such as a mesh barrier, can be provided in an opening of an outer housing so that undesired foreign substances can be blocked from further entry into the opening in the outer housing.

27 Claims, 7 Drawing Sheets

U.S. PATENT DOCUMENTS

2011/0255260 A1* 10/2011 Weber et al. ..... 361/807
2011/0255726 A1* 10/2011 Yu et al. ..... 381/332
2011/0255850 A1* 10/2011 Dinh et al. ..... 396/176
2012/0009983 A1* 1/2012 Mow et al. ..... 455/575.7
2012/0045081 A1* 2/2012 Mittleman et al. ..... 381/334
2012/0177237 A1* 7/2012 Shukla et al. ..... 381/332

* cited by examiner

AUDIO PORT CONFIGURATION FOR COMPACT ELECTRONIC DEVICES

CROSS-REFERENCE TO RELATED APPLICATION

This application claims priority benefit of U.S. Provisional Application No. 61/325,803, filed Apr. 19, 2010 and entitled "AUDIO PORT CONFIGURATION FOR COMPACT ELECTRONIC DEVICES."

BACKGROUND OF THE INVENTION

1. Field of the Invention

The present invention relates to audio ports for electronic devices and, more particularly, for audio port configurations for compact electronic devices.

2. Description of the Related Art

Today, it is popular for portable electronic devices, such as notebook computers, netbook computers, portable digital assistants (PDAs), smart phones, digital audio players (e.g., MP3 players) and the like, include at least one speaker to produce audio sound output and at least one microphone to receive audio sound input.

Portable electronic devices often provide audio jacks (i.e., audio connectors) that facilitate connection with headsets or headphones which provide personal external speakers for their users. Alternatively or additionally, portable electronic devices can provide one or more internal speakers that are able to be utilized for producing audio sound. Similarly, portable electronic devices can have a microphone jack that facilitates connection with a microphone which can be externally provided for a user. Alternatively or additionally, portable electronic device can provide one or more internal microphones that are able to be used to pickup (i.e., receive) audio sound.

There is, however, an ongoing need to make portable electronic devices smaller and thinner. As portable electronic devices get smaller and thinner, there are increased difficulties in providing the same or greater functionality in a smaller area. With respect to audio sound, a portable electronic device can utilize at least one or two speakers and one or more microphones provided internal to the housing of the portable electronic device. Unfortunately, given the area constraints imposed on many portable electronic devices, it is increasingly difficult to provide high-quality audio sound output and pickup without hindering the ability to make portable electronic devices smaller and thinner. Consequently, there is a need for improved approaches to provide high-quality audio sound output and/or pickup from portable electronic devices as they get smaller and thinner.

SUMMARY

The invention pertains to a portable electronic device that provides compact configurations for audio elements. The audio elements can be drivers (e.g., speakers) or receivers (e.g., microphones). In one embodiment, an audio element can be mounted on or coupled to an intermediate structure (e.g., a flexible electrical substrate) having an opening therein to allow audio sound to pass there through. In another embodiment, an audio chamber can be formed to assist in directing audio sound between an opening an outer housing and a flexible electronic substrate to which the audio element is mounted or coupled thereto. In still another embodiment, a barrier, such as a mesh barrier, can be provided in an opening of an outer housing so that undesired foreign substances can be blocked from further entry into the opening in the outer housing.

The invention can be implemented in numerous ways, including as a method, system, device, or apparatus. Several embodiments of the invention are discussed below.

According to one embodiment, a portable electronic device can include a housing having an opening. The portable electronic device can also include an intermediate structure provided internal to the housing and having an opening there through. Still further, the portable electronic device can also include an audio element. The audio element can be secured to a first surface of the intermediate structure such that the audio element is acoustically coupled to the opening in the intermediate structure.

According to another embodiment, a portable electronic device can include a housing having an opening. The portable electronic device can also include an intermediate structure provided internal to the housing and having an opening there through. In addition, the portable electronic device can include an audio element. The audio element can be secured to a first surface of the intermediate structure such that the audio element is acoustically coupled to the opening in the housing by way of the opening in the intermediate structure. The portable electronic device can further include an audio chamber acoustically coupled to a second surface of the intermediate structure.

According to still another embodiment, a portable electronic device can include a housing having an opening. The portable electronic device can also include a flexible electrical substrate having an opening there through. Still further, the portable electronic device can also include an audio assembly. The audio assembly being secured to a first surface of the flexible electrical substrate such that the audio assembly is provided over the opening in the flexible electrical substrate.

According to yet still another embodiment, a portable electronic device can include a housing including an opening for emitting audio sound. The portable electronic device can also include a mesh barrier assembly configured to be inserted into the opening of the housing of the portable electronic device. The mesh barrier assembly can include at least a mesh screen and a support structure configured to support the mesh screen.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

It should be noted that FIGS. 2A-7 are not drawn to scale. Instead, these figures are enlarged so that features are more readily visible.

DETAILED DESCRIPTION OF EMBODIMENTS OF THE INVENTION

The invention pertains to a portable electronic device that provides compact configurations for audio elements. The audio elements can be drivers (e.g., speakers) or receivers (e.g., microphones). In one embodiment, an audio element can be mounted on or coupled to an intermediate structure (e.g., a flexible electrical substrate) having an opening therein to allow audio sound to pass there through. In another embodiment, an audio chamber can be formed to assist in directing audio sound between an opening an outer housing and a flexible electronic substrate to which the audio element is mounted or coupled thereto. In still another embodiment, a barrier, such as a mesh barrier, can be provided in an opening of an outer housing so that undesired foreign substances can be blocked from further entry into the opening in the outer housing.

Exemplary embodiments of the invention are discussed below with reference to FIGS. 1-7. However, those skilled in the art will readily appreciate that the detailed description given herein with respect to these figures is for explanatory purposes as the invention extends beyond these limited embodiments.

Figure 1:
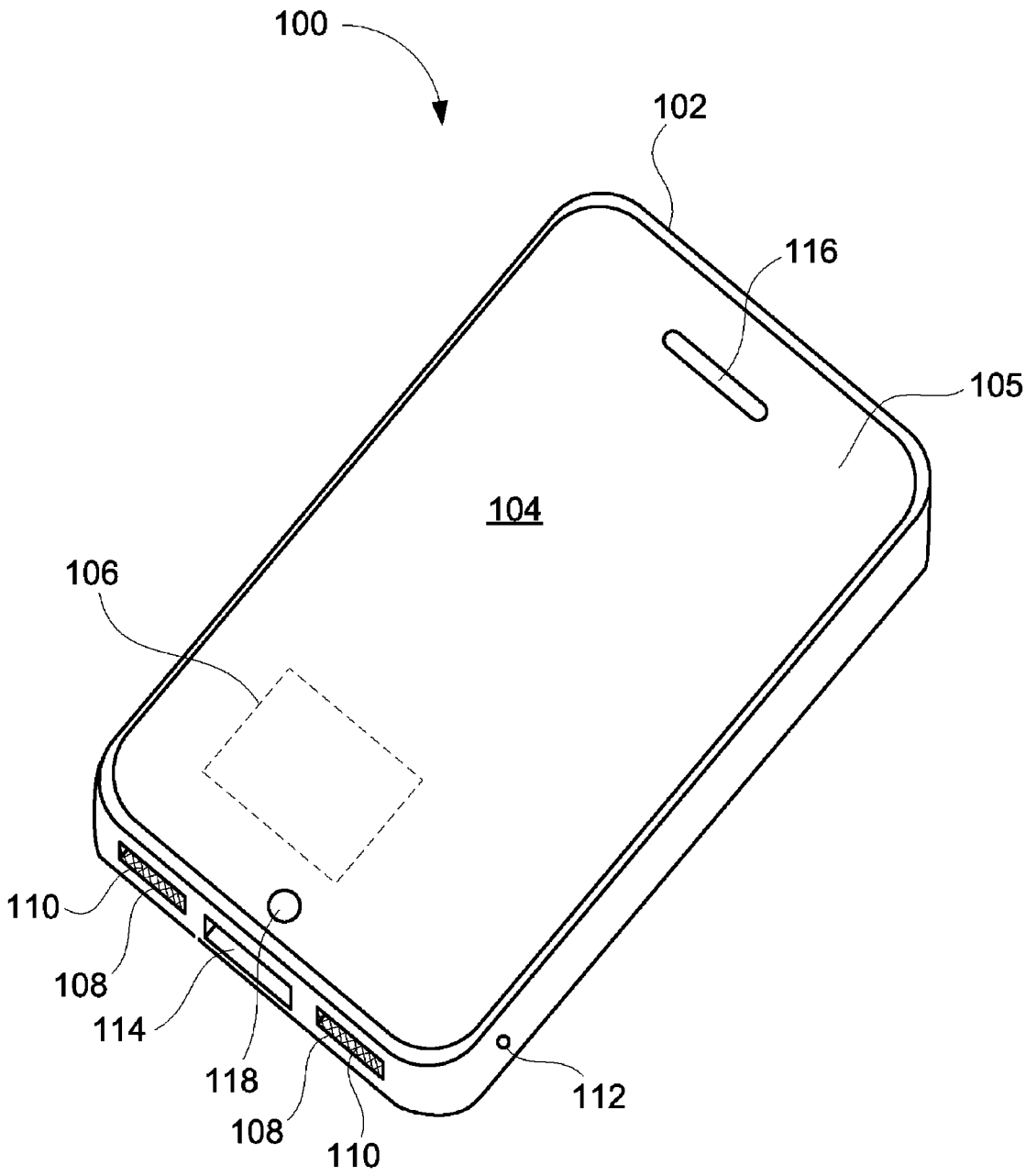
FIG. 1 is a perspective diagram of a portable electronic device according to one embodiment.

FIG. 1 is a perspective diagram of a portable electronic device 100 according to one embodiment. The portable electronic device 100 is a representative illustration for a portable electronic device. However, it should be understood that, in other embodiments, the size, scale, shape, configuration and/or appearance of the portable electronic device 100 can vary widely.

The portable electronic device 100 includes a housing 102 that provides an exterior surface for the portable electronic device 100. The portable electronic device 100 provides one or more functional capabilities that can be utilized by its user. In so doing, the portable electronic device can include at least one input/output component 104.

The user input/output component 104 typically includes one or more user input devices and/or one or more output device. The one or more user input devices can allow the user to interact with the portable electronic device. The one or more output devices can provide outputs from the portable electronic device to the user or another device. The input/output component 104 can, for example, pertain to one or more of a display, a touch screen, a touchpad, a keypad, a button, a dial, and etc. For example, the input/output component 104 can provide a display and a touch screen combination, with the display providing output capability and the touch screen providing input capability.

The portable electronic device 100 can also include an audio circuit 106. The audio circuit 106 is typically provided internal to the housing 102 of the portable electronic device 100. The audio circuit 106 can operate to produce audio signals that can be supplied to one or more speakers internal to the housing 102 of the portable electronic device 100. The one or more speakers, in response to the audio signals, can produce audio sound that can be directed (e.g., by way of one or more acoustic chambers) to one or more audio output openings 108 in the housing 102 of the portable electronic device 100. In one embodiment, each of the one or more audio output openings 108 can include a mesh cover 110 that serves to protect foreign matter from entering into the housing 102 of the portable electronic device 100 by way of the audio output opening 108.

The audio circuit 106 can also operate to receive audio signals that are picked-up by one or more microphones internal to the housing 102 of the portable electronic device 100. The one or more microphones can pick-up audio sounds that are received (e.g., directly or by way of one or more acoustic chambers) via an audio input opening 112 in the housing 102 of the portable electronic device 100. In general, the portable electronic device 100 can place the audio input opening 112 in any of various location. However, in this embodiment, the audio input opening 112 is provided on a side of the housing 102. In one embodiment, the audio input opening 112 can also include a mesh cover (not shown) that serves to protect foreign matter from entering into the housing 102 of the portable electronic device 100 by way of the audio input opening 112.

The housing 102 of the portable electronic device 100 can also include an external connection port 114. The external connection port 114 allows the portable electronic device 100 to be connected to a host device (e.g., personal computer) or other electronic devices (e.g., docking station), so as to exchange data or to charge a battery (not shown) utilized by the portable electronic device 100.

The portable electronic device 100 can also include a receiver opening 116 and a button opening 118. The receiver opening 116 can be provided adjacent an internal receiver (e.g., speaker) that can provide audio output to a user of the portable electronic device 100. The button opening 118 can be provided adjacent a button that allows the user to interact with the portable electronic device 100. Although the receiver opening 116 and the button opening can be provided in the translucent face 105, it should be understood that these components could be provided elsewhere in the portable electronic device. For example, these components could be provided at the side of the portable electronic device 100. The translucent face 105 can be a glass sheet or a plastic sheet. The translucent face 105 provides a front face for the housing. The translucent face is also thin, such as having a thickness of less than 1 millimeter.

The portable electronic device 100 can include any suitable type of electronic device having a display. For example, the portable electronic device 100 can be a laptop, tablet computer, media player, phone, GPS unit, remote control, personal digital assistant (PDA), and the like, and devices combining some or all of this functionality. Depending on the capabilities of the portable electronic device, internal to the portable electronic device 100 are various electrical components that serve support the device capabilities. The electronic components include one or more of integrated circuit(s), electronic substrate(s) (flex circuits, printed circuit boards), wireless transceiver(s), battery(s), microphone(s), speaker(s), display circuitry(s), touch circuitry(s), and connectors (e.g., ports), user input devices (button, switches, etc.).

According to one aspect, a portable electronic device can be provided with a compact configuration for audio elements. The audio elements can be drivers (e.g., speakers) or receivers (e.g., microphones). In one embodiment, an audio element can be mounted on or coupled to an intermediate structure (e.g., a flexible electrical substrate) having an opening therein to allow audio sound to pass there through. In another embodiment, an audio chamber can be formed to assist in directing audio sound between an opening an outer housing and a flexible electronic substrate to which the audio element is mounted or coupled thereto.

Figure 2A:
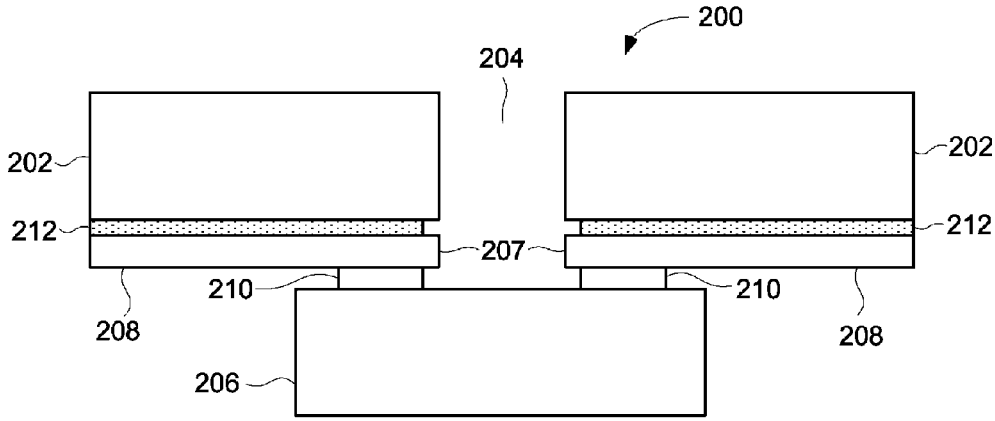
FIG. 2A is a partial cross-sectional diagram of a portable electronic device according to one embodiment.

FIG. 2A is a partial cross-sectional diagram of a portable electronic device 200 according to one embodiment. The portable electronic device 200 includes a housing 202 for the portable electronic device 300. The housing 202 has an opening 204 that allows audio sound to be emitted or received from the portable electronic device 200. The portable electronic device includes an audio element 206 provided internal to the housing 202 for the portable electronic device 200. The audio element 206 can represent a speaker driver (e.g., speaker) and/or a receiver (e.g., microphone). The speaker driver 206 upon controlled activation produces audio sound that can be directed out of the opening 204 of the housing 202. For example, the audio sound can be associated with playback of digital media asset, such as a video file (e.g., movie), an audio file (e.g., music or podcast), etc., by the portable electronic device 200. As another example, in the case of the speaker driver 206, the audio sound can be associated with a user, such as a voice conversation, using the portable electronic device 200 as a wireless telephone. As an example, in the case of the receiver 206, the audio sound can be picked-up via the opening 204 if the housing 202. The sound, in this example, can be environment or can be audio sound (e.g., voice communications) associated with a user.

In the low-profile design for the portable electronic device 200, the compactness of the portable electronic device 200 is of design importance. Consequently, placement of the audio element 206 within the housing 202 for the portable electronic device 200 is managed such that the overall size and/or thickness of the portable electronic device 200 is able to remain compact (e.g., thin).

As shown in FIG. 2A, the audio element 206 can be provided proximate to the opening 204 in the housing 202. Although the audio element 206 can be provided adjacent to the opening 204, there may be one or more intermediate structures. An audio chamber can be established at least between the audio element 206 and the opening 204. In the embodiment illustrated in FIG. 2A, the audio chamber can extend from the speaker driver 206 to the opening 204 in the housing 202. As such, the audio chamber passes through an opening 207 within a flexible electronic substrate 208. The flexible electrical substrate 208 is, for example, a flex circuit. The flexible electrical substrate 208 can provide electrical traces, pads, and the like that support electronic devices and/or electrical interconnections between electronic devices. The portable electronic device 200 can include a printed circuit board (PCB) (not shown) and the flexible electronic substrate 208 can couple to the PCB. The audio element 206 can be coupled to the flexible electrical substrate 208 such that the speaker driver 206 is acoustically coupled to audio chamber that directs audio sound to the opening 204 in the housing 202. In one implementation, the audio element 206 can be acoustically sealed to a first surface of the flexible electrical substrate 208 by a seal 210. The seal 210 can, for example, by provided by a layer of adhesive, a compliant gasket (e.g., form gasket), or solder. In the case where a gasket is used, an adhesive can be used to adhere the seal 210 to the first surface of the flexible electrical substrate 208 as well as to the audio element 206. In addition, in one implementation, a second surface of the flexible electrical substrate 208 can be adhered to the housing 202. For example, the flexible electrical substrate 208 can be adhered to the housing 202 through use of a thin layer of adhesive 212 provided between the second surface of the flexible electrical substrate 208 and the housing 210. The opening 207 in the flexible electrical substrate 208 facilitates mounting of the audio element 206 to the flexible electrical substrate 208, whereby the audio element 206 can emit or receive sound through the opening 207 in the flexible electrical substrate 208 so that the sound being emitted or received can pass through the opening 204 in the housing 202.

Figure 2B:
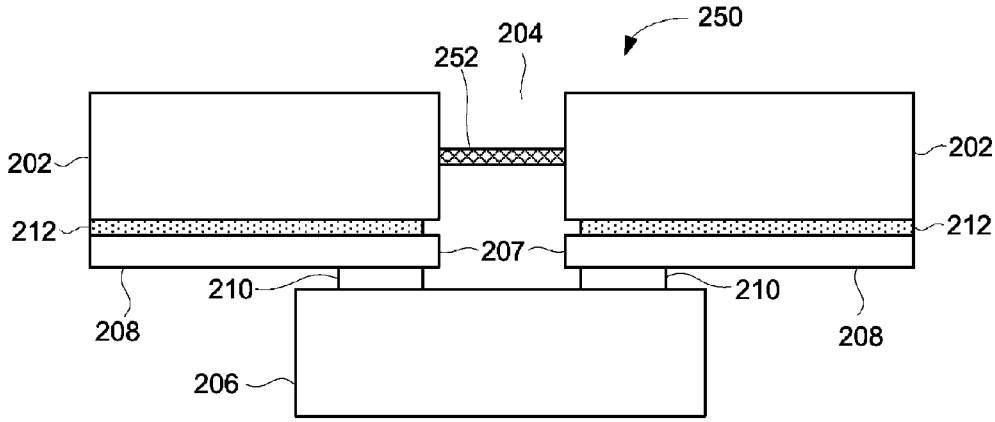
FIG. 2B is a partial cross-sectional diagram of a portable electronic device according to one embodiment.

FIG. 2B is a partial cross-sectional diagram of a portable electronic device 250 according to one embodiment. The portable electronic device 250 is generally similar to the portable electronic device 200 illustrated in FIG. 2A. However, the portable electronic device 250 further includes a mesh screen 252 provided in the opening 204 of the housing 202. The mesh screen 252 serves as a device that does not substantially impede audio sound through the opening 204, but does provide a barrier that impedes foreign substances (e.g., dust, dirt) from passing through the opening 207. The mesh screen 252 can be formed from any of a variety of materials, including fabrics or fibers, either natural or synthetic. As one particular example, the mesh screen 252 can be formed of nylon fibers. Further discussion provided below describes different embodiments by which the mesh screen 252 can be provided and/or retained within the opening 204. In some embodiments, the mesh screen 252 can also be removable from the opening 204 of the housing 202. By being removable, the screen mesh 252 and any accumulated foreign substances can be cleaned or removed, and thereafter the screen mesh 252 can be re-inserted.

Figure 3A:
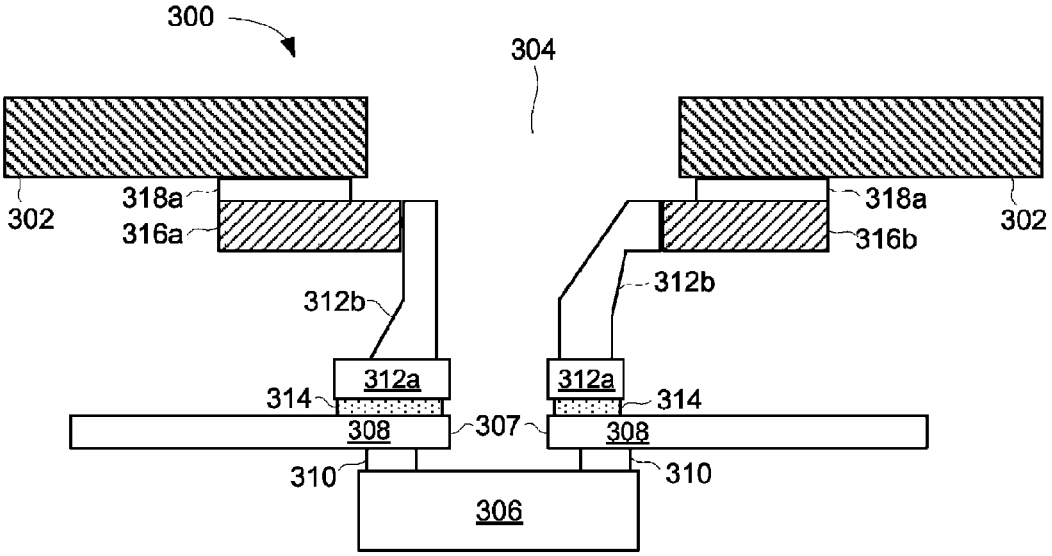
FIG. 3A is a partial cross-sectional diagram of a portable electronic device according to one embodiment.

FIG. 3A is a partial cross-sectional diagram of a portable electronic device 300 according to one embodiment. The portable electronic device 300 includes a housing 302 for the portable electronic device 300. The housing 302 has an opening 304 that allows audio sound to be emitted from the portable electronic device 300. The portable electronic device 300 includes an audio element 306 provided internal to the housing 302 for the portable electronic device 300. The audio element 306 can represent a speaker driver (e.g., speaker) and/or a receiver (e.g., microphone). The speaker driver 306 upon controlled activation produces audio sound that can be directed out of the opening 304 of the housing 302. For example, the audio sound can be associated with playback of digital media asset, such as a video file (e.g., movie), an audio file (e.g., music or podcast), etc., by the portable electronic device 300. As another example, in the case of the speaker driver 306, the audio sound can be associated with a user, such as a voice conversation, using the portable electronic device 300 as a wireless telephone. As an example, in the case of the receiver 306, the audio sound can be picked-up via the opening 304 if the housing 302. The sound, in this example, can be environment or can be audio sound (e.g., voice communications) associated with a user.

In the low-profile design for the portable electronic device 300, the compactness of the portable electronic device 300 is of design importance. Consequently, placement of the audio element 306 within the housing 302 for the portable electronic device 300 is managed such that the overall size and/or thickness of the portable electronic device 300 is able to remain compact (e.g., thin).

As shown in FIG. 3A, an audio chamber can be established between the speaker driver 206 and the opening 204. The audio element 306 can be acoustically coupled to the opening 304 in the housing 302 by the audio chamber. In the embodiment illustrated in FIG. 3A, the audio chamber can extend from the speaker driver 306 to the opening 304 in the housing 302. As such, the audio chamber passes through an opening 307 within a flexible electronic substrate 308. The flexible electrical substrate 308 is, for example, a flex circuit. The flexible electrical substrate 308 can provide electrical traces, pads, vias, and the like that support electronic devices and/or electrical interconnections between electronic devices. The portable electronic device 300 can include a printed circuit board (PCB) (not shown) and the flexible electronic substrate 308 can couple to the PCB. The audio element 306 can be coupled to the flexible electrical substrate 308 such that the speaker driver 306 is acoustically coupled to audio chamber that directs audio sound to the opening 304 in the housing 302. In one implementation, the audio element 306 can be acoustically sealed to a first surface of the flexible electrical substrate 308 by a seal 310. The seal 310 can, for example, by provided by a layer of adhesive, a compliant gasket (e.g., form gasket), or solder. In the case where a gasket is used, an adhesive can be used to adhere the seal 310 to the first surface of the flexible electrical substrate 308 as well as to the audio element 306.

To support the audio chamber, the portable electronic device 300 can also include an audio boot 312. The audio boot 312 can include an upper boot portion 312*a* and a lower boot portion 312*b*. In one implementation, the upper boot portion 312*a* is a rigid member, and the lower boot portion 312*b* is a compliant member. The rigidity of the upper boot member 312*a* and the compliance of the lower boot member 312*b* are relative to one another. The audio boot 312 is normally a single structure and can be formed with a molding process with respect to elastomers (e.g., plastics (including thermoplastics elastomers), rubber or foams), such as nylon, silicone, Acrylonitrile Butadiene Styrene (ABS), or polypropylene. For example, a co-molding or overmolding process can be performed to integrally form the audio boot 312 having the upper boot portion 312*a* and the lower boot portion 312*b*. The upper boot member 312*a* can be adhered to a second surface of the flexible electronic substrate 308. For example, an adhesive layer 314 can be provided between a second surface of the flexible electrical substrate 308 and the upper boot member 312*a*. The lower boot portion 312*b* can be provided adjacent the opening 304 in the housing 302. Specifically, the portable electronic device 300 can also include inner structures 316*a*, 316*b*. The inner structures 316*a*, 316*b* can be adhered to the housing 302. Adherence member 318*a*, 318*b* can be provided to adhere the inner structures 316*a*, 316*b* to the housing 302. The lower boot member 312*b* can also seal against the inner structures 316*a*, 316*b* and/or support the audio boot 312.

The opening 307 in the flexible electrical substrate 308 and the audio boot 312 both facilitate providing the audio chamber. The audio element 306 can emit or receive sound through the opening 307 in the flexible electrical substrate 308 and then through the audio chamber so that the sound being emitted or received by the audio element 306 can pass through the opening 304 in the housing 302.

Figure 3B:
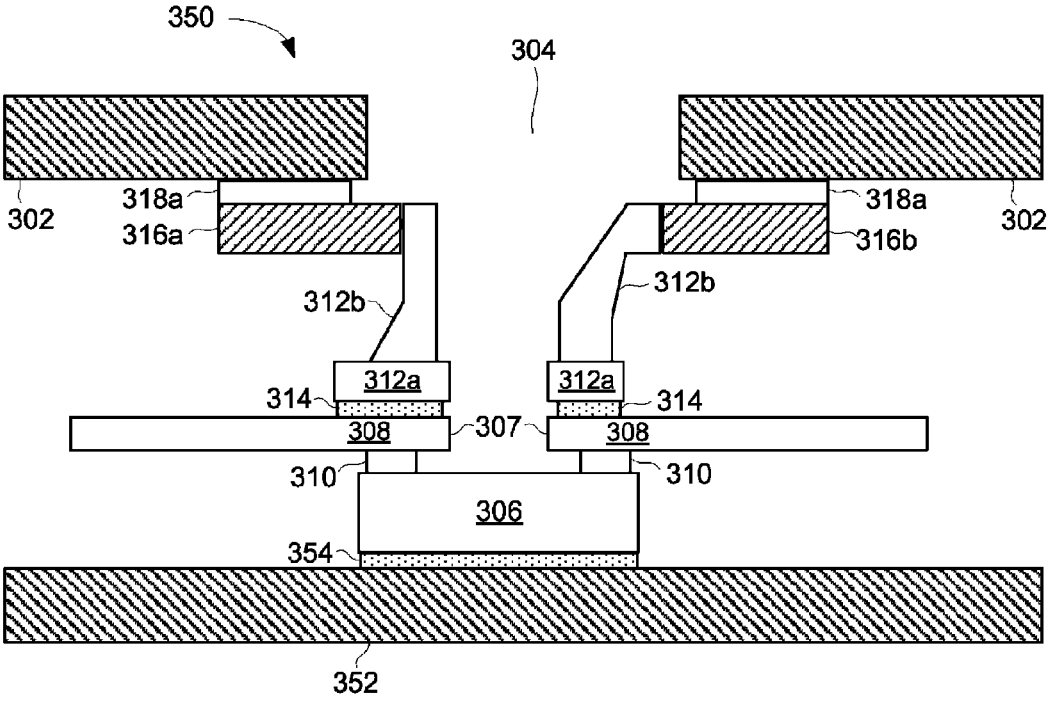
FIG. 3B is a partial cross-sectional diagram of a portable electronic device according to one embodiment.

FIG. 3B is a partial cross-sectional diagram of a portable electronic device 350 according to one embodiment. The portable electronic device 350 is generally similar to the portable electronic device 300 illustrated in FIG. 3A. However, the portable electronic device 350 further illustrates a device structure 352. The device structure 352 can represent an inner structure internal to the portable electronic device 350. Alternatively, the device structure 352 can represent an outer housing of the portable electronic device 350. For example, the housing 302 can pertain to a first wall of the outer housing of the portable electronic device 350, and the device structure 352 can pertain to a second wall of the outer housing of the portable electronic device 350. A layer of material 354 can couple between the audio element 306 and the device structure 352. The layer of material 354 can pertain to a layer of adhesive or a foam member. In one implementation, the layer of material 354 can provide structural coupling between a surface of the audio element 306 and a surface of the device structure 352. In another implementation, the layer of material 354 can provide acoustic coupling between a surface of the audio element 306 and a surface of the device structure 352. For example, if an acoustic volume (e.g., back volume) is to be provided acoustically coupled to the surface of the audio element (i.e., speaker device) 306, the layer of material 354 can participate in the acoustic coupling for the acoustic volume.

Figure 3C:
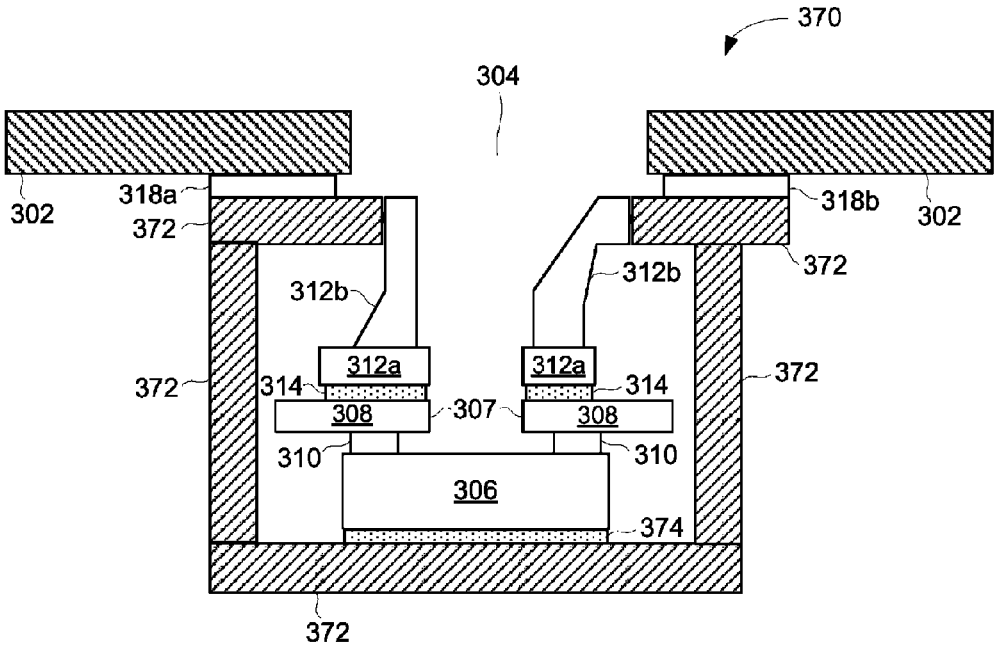
FIG. 3C is a partial cross-sectional diagram of a portable electronic device according to another embodiment.

FIG. 3C is a partial cross-sectional diagram of a portable electronic device 370 according to another embodiment. The portable electronic device 370 is generally similar to the portable electronic device 300 illustrated in FIG. 3A. However, the portable electronic device 370 further illustrates an internal support structure 372. The internal support structure 372 can represent an inner structure internal to the portable electronic device 370. A layer of material 354 can couple between the speaker device 306 and the internal support structure 372. The layer of material 374 can pertain to a layer of adhesive or a foam member. In one implementation, the layer of material 374 can provide structural coupling between a surface of the audio element 306 and a surface of the internal support structure 372. In another implementation, the layer of material 374 can provide acoustic coupling between a surface of the audio element 306 and a surface of the internal support structure 372. For example, if an acoustic volume (e.g., back volume) is to be provided acoustically coupled to the surface of the audio element (i.e., speaker device) 306, the layer of material 374 can participate in the acoustic coupling for the acoustic volume.

Figure 4A:
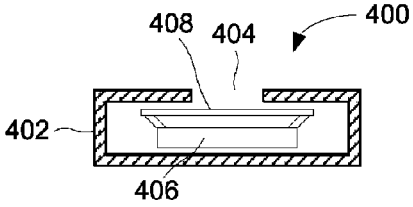
FIG. 4A is a cross-sectional view of a speaker driver according to one embodiment.

FIG. 4A is a cross-sectional view of a speaker driver 400 according to one embodiment. The speaker driver 400 can pertain to the audio element (operating as a speaker driver) 206, 306 in FIGS. 2A, 2B, 3A, 3B and 3C. The speaker driver 400 can pertain to a dynamic speaker. The speaker driver 400 includes a speaker housing 402. The speaker housing 402 has an opening 404 through which generated sound wave can be expelled from the opening 404. The internal structure of the speaker driver 400 can include a driver element 406 (e.g., magnet and coil) and a diaphragm 408.

Although the speaker driver 400 includes a speaker housing 402, it should be noted that in another embodiment, the speaker driver 400 can be mounted internal to an electronic device housing without a dedicated speaker housing, i.e., without the speaker housing 402. In one implementation, the driver element 406 (e.g., magnet and coil) and the diaphragm 408 can be secured to the electronic device housing (without a dedicated speaker housing).

Figure 4B:
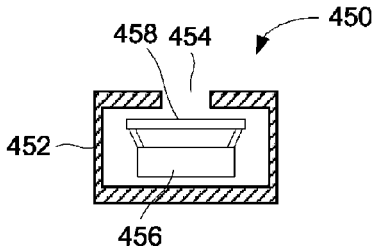
FIG. 4B is a cross-sectional view of a receiver according to one embodiment.

FIG. 4B is a cross-sectional view of a receiver 450 according to one embodiment. The receiver 450 can pertain to the audio element (operating as a microphone) 206, 306 in FIGS. 2A, 2B, 3A, 3B and 3C. The receiver 450 can pertain to a MEMS microphone. The receiver 450 includes a receiver housing 452. The receiver housing 452 has an opening 454 through which generated sound wave can be expelled from the opening 454. The internal structure of the receiver 450 can include a receiver element 456 (e.g., magnet and coil) and a diaphragm 458.

Although the receiver 450 includes a receiver housing 452, it should be noted that in another embodiment, the receiver 450 can be mounted internal to an electronic device housing without a dedicated receiver housing, i.e., without the receiver housing 452. In one implementation, the receiver element 456 (e.g., magnet and coil) and the diaphragm 458 can be secured to the electronic device housing (without a dedicated receiver housing).

According to another aspect, a barrier, such as a mesh barrier, can be provided in an opening of an outer housing so that undesired foreign substances can be blocked from further entry into the opening in the outer housing.

Figure 5A:
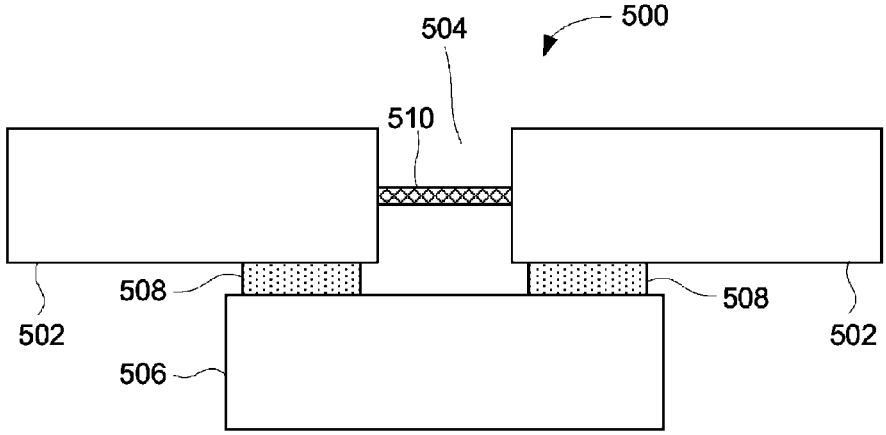
FIG. 5A is a partial cross-sectional diagram of a portable electronic device according to one embodiment.

FIG. 5A is a partial cross-sectional diagram of a portable electronic device 500 according to one embodiment. The portable electronic device 500 includes a housing 502 for the portable electronic device 500. The housing 502 has an opening 504 that allows audio sound to be emitted or received from the portable electronic device 500. The portable electronic device 500 also includes an audio element 506 provided internal to the housing 502 for the portable electronic device 500. As shown in FIG. 5A, the speaker driver 506 can be provided adjacent to the opening 504 in the housing 502.

The audio element 506 can, for example, represent a speaker driver (e.g., speaker) and/or a receiver (e.g., microphone). When the audio element 506 includes a speaker, the speaker driver, upon controlled activation, produces audio sound that can be directed out of the opening 504 of the housing 502. For example, the audio sound can be associated with playback of digital media asset, such as a video file (e.g., movie), an audio file (e.g., music or podcast), etc., by the portable electronic device 500. As another example, in the case of the speaker driver, the audio sound can be associated with a user, such as a voice conversation, using the portable electronic device 500 as a wireless telephone. Alternatively, when the audio element 506 includes the receiver, the audio sound can be picked-up via the opening 504 if the housing 502. The sound, in this example, can be environment or can be audio sound (e.g., voice communications) associated with a user.

An intermediate layer 508 can be provided between the audio element 506 and a portion of the housing 502. The intermediate layer 508 can serve to seal and/or bond the audio element 506 to the housing 502. When the intermediate layer 508 is providing sealing, the intermediate layer 508 is a compliant member (e.g., foam, rubber, silicone) that can provide an acoustic seal between the audio element 506 and the housing 502. The complaint member can, for example, be a gasket for the audio element 506. When the intermediate layer 508 is providing bonding, the intermediate layer 508 can be an adhesive layer or a mechanical structure (e.g., screw, snap, solder, etc.) that serves to bond the audio element 506 with the housing 502. The intermediate layer 508 can also provide both sealing and bonding (e.g., compliant member as well as adhesive).

The portable electronic device 500 can further optionally include a mesh screen 510 provided in the opening 504 of the housing 502. The mesh screen 510 serves as a device that does not substantially impede audio sound input/output through the opening 204, but does provide a barrier for foreign substances (e.g., dust, dirt). The mesh screen 510 operates to reduce accumulation of foreign substances within the opening 504. The mesh screen 510 can be formed from fabrics or fibers, either natural or synthetic. As one particular example, the mesh screen 510 can be formed of nylon fibers.

Figure 5B:
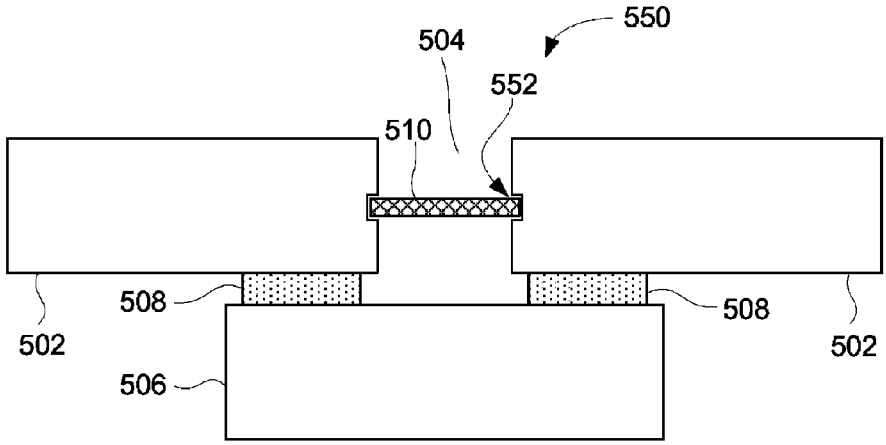
FIG. 5B is a partial cross-sectional diagram of a portable electronic device according to one embodiment.

FIG. 5B is a partial cross-sectional diagram of a portable electronic device 550 according to one embodiment. The portable electronic device 550 is generally similar to the portable electronic device 500 illustrated in FIG. 5A. However, the portable electronic device 550 further includes a notch 552 in the opening 504 of the housing 502. The mesh screen 510 can be held in position within the opening 504 by placing the mesh screen 510 in the notch 552. Alternatively or additionally, a ridge, a detent, a nub, an adhesive, etc. can be used to hold the mesh screen 510 in position within the opening 504 of the housing 502.

In other embodiment, a support structure can assist with insertion into the opening 504 and with retaining the mesh screen 510 at the proper position within the opening 504. A support structure can be particularly useful when the mesh screen 510 is formed of fabric or fibers. In one embodiment, the diameter of the opening 504 and the mesh screen 510 is ten (10) millimeters or less. In another embodiment, the diameter of the opening 504 and the mesh screen 510 is approximately one (1) millimeter. In any case, the structure support can made insertion and retention of the mesh screen 510 manageable even though the diameter of the opening 504 is very small.

Figure 6A:
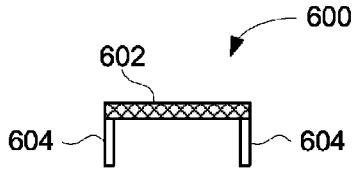
FIGS. 6A-6C are diagrams illustrating insertion of a mesh barrier assembly into an opening in a housing of a portable electronic device according to one embodiment.
Figure 6B:
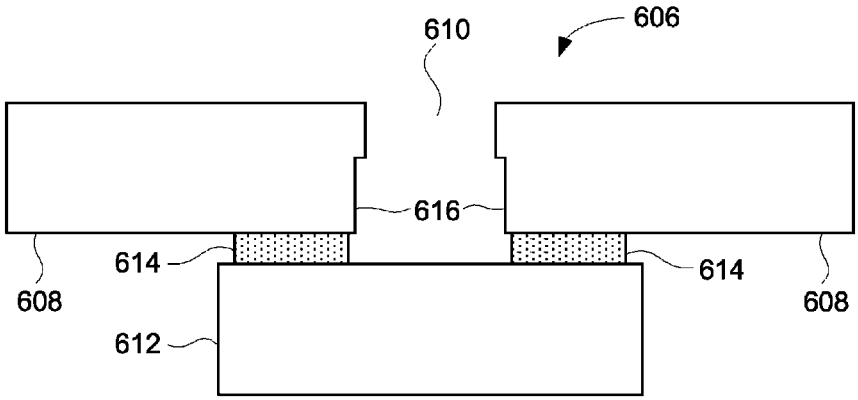
Figure 6C:
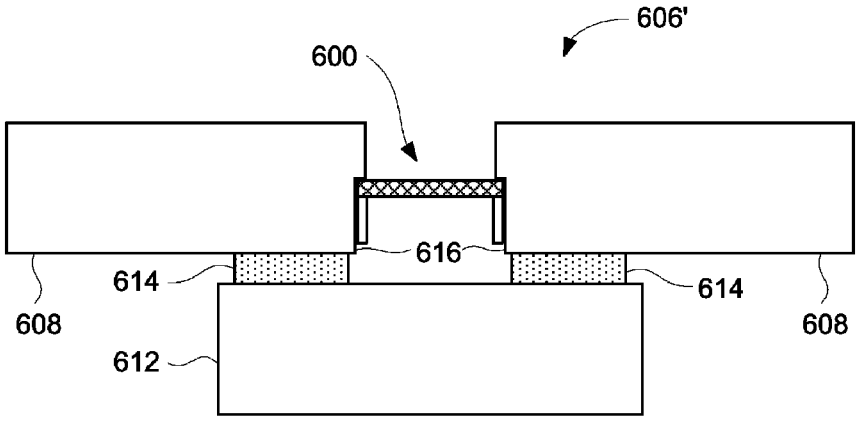

FIGS. 6A-6C are diagrams illustrating insertion of a mesh barrier assembly into an opening in a housing of a portable electronic device according to one embodiment.

FIG. 6A is a cross-sectional diagram of a mesh barrier assembly 600 according to one embodiment. The mesh barrier assembly 600 includes a mesh barrier 602 attached to a support structure 604. The mesh barrier can be formed, for example, by a die cutting process. The mesh barrier 602 can be rendered integral with the support structure 604, such as by way of an over-molding or co-molding process. Alternatively, the mesh barrier 602 can be separately formed attached together, e.g., by adhesive, thermal bonding or mechanical means. In one implementation, to facilitate assembly, a plurality of mesh barriers can be partially die cut in a sheet of mesh fabric, then support structures can be attached or formed onto the corresponding mesh barriers, and then finally the mesh barriers can be completely cut from the sheet of mesh fabric.

FIG. 6B is a partial cross-sectional diagram of a portable electronic device 606 according to one embodiment. The portable electronic device 606 includes a housing 608 for the portable electronic device 606. The housing 608 has an opening 610 that allows audio sound to be emitted from the portable electronic device 606. The portable electronic device 606 includes a speaker driver 612 provided internal to the housing 606 for the portable electronic device 606. The speaker driver 612 upon controlled activation produces audio sound that can be directed out of the opening 610 of the housing 606. As shown in FIG. 6B, the speaker driver 612 can be provided adjacent to the opening 610 in the housing 606. A bonding layer 614 can be provided to secure the speaker driver 612 to the housing 606. The bonding layer 614 can be an adhesive layer or a mechanical structure (e.g., screw, snap, solder, etc.). Additionally, the opening 610 can include a recessed region 616 that facilitates retention of the mesh barrier assembly 600 within the opening 610.

FIG. 6C is a partial cross-sectional diagram of a portable electronic device 606' according to one embodiment. The portable electronic device 606' is the same as the portable electronic device 606 illustrated in FIG. 6B except that the mesh barrier assembly 600 has been inserted into the opening 610. When inserted, the mesh barrier assembly 600 is retained within the opening 610 with the assistance of the recessed region 616 and/or frictional coupling. The support structure 604 can have a configuration that corresponds to the configuration of the opening 610 or the recessed region 616 of the opening 610. The support structure 604 can also be used in controlling to placement of the mesh barrier assembly 600 within the opening 610, such as controlling its depth or recessed amount within the opening 610. Although the mesh barrier assembly 600 is retained within the opening 610, the mesh barrier assembly 600 can in some embodiments be thereafter removed for servicing (such as cleaning the mesh barrier 602). In an alternative embodiment, the recessed region 616 is not required but the support structure 604 can be retained within the opening by simply fictional coupling. In still another embodiment, an adhesive couple be provided to secure the support structure 604 within the opening 610, though controlling the location of the adhesive can be difficult and can hinder audio performance if the adhesive misplaced.

In an alternative embodiment, the portable electronic device 600, 600' can use a microphone instead of the speaker driver. In such case, the block 612 can be considered a microphone. For example, the microphone is small, such as a MEMS microphone.

In one embodiment, the scale of the housing 608 and the opening 610 in the housing 608 are rather small. For example, the thickness of the housing 608 can be approximately 2.5 millimeters (mm), and the opening 610 can be approximately 1 mm in diameter. The mesh barrier assembly 600 in such an embodiment would have a width on the order of 1 mm, and a height of approximately 1 mm to 2 mm.

Figure 7:
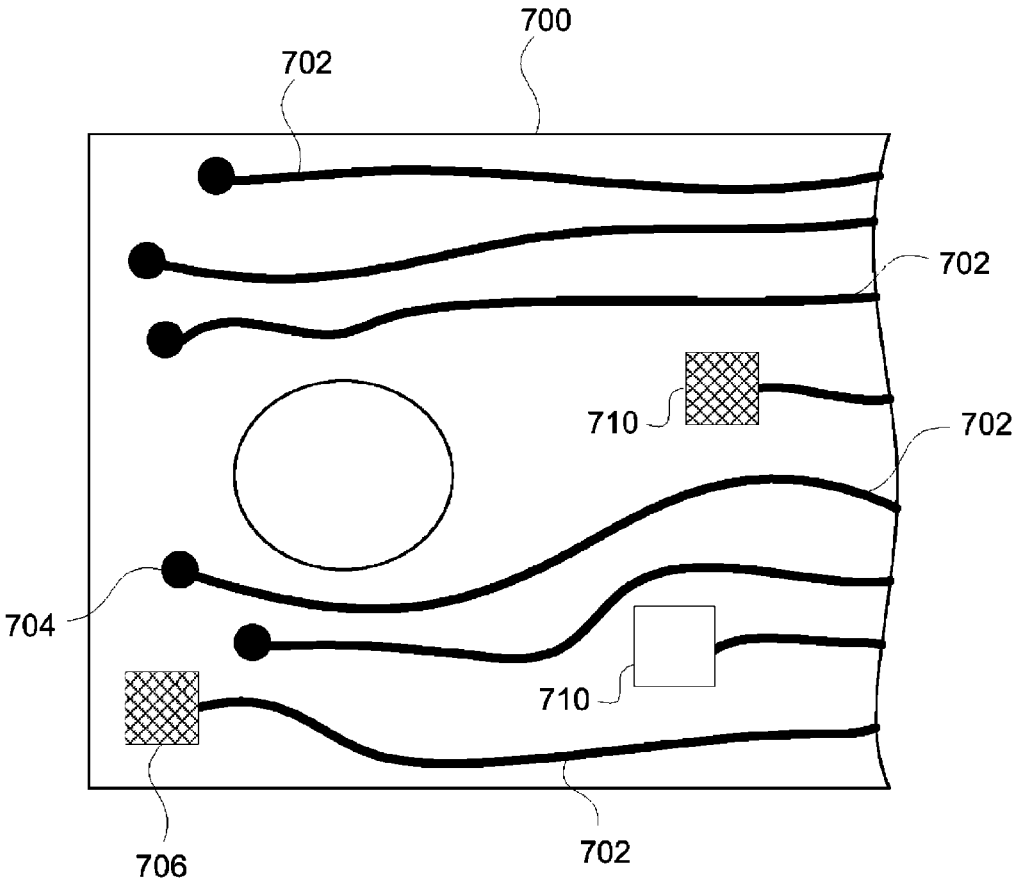
FIG. 7 is a top view of a portion of a flexible substrate according to one embodiment.

FIG. 7 is a top view of a portion of a flexible substrate 700 according to one embodiment. The flexible substrate 700 can, for example, be a flex circuit. The flexible substrate 700 can provide electrical traces 702, electrical connections 704 and/or electrical pads 706 on one or both primary surfaces of the flexible substrate 700. The flexible substrate 700 can also include an opening 708 there through for supporting an audio port as discussed above where a speaker driver assembly can be coupled to the flexible substrate 700 over or adjacent the opening 708.

Further, various electronic components can be attached to the flexible substrate 700. These electrical components can include transistors, capacitors, resistors, inductors, integrated circuits, microphones, sensors, switches, etc. For example, the flexible substrate 700 can include a representative electrical component 710 electrically and mechanically attached to the flexible substrate 700.

Additional details on speaker arrangements can be found in U.S. patent application Ser. No. 12/698,957, filed Feb. 2, 2010 and entitled "LOW-PROFILE SPEAKER ARRANGEMENTS FOR COMPACT ELECTRONIC DEVICES," which is hereby incorporated herein by reference.

Embodiments of the invention are well suited for portable, battery-powered electronic devices, and more particularly handheld battery-powered electronic devices. Examples of portable, battery-powered electronic devices can include laptops, tablet computers, media players, phones, GPS units, remote controls, personal digital assistant (PDAs), and the like.

The various aspects, features, embodiments or implementations of the invention described above can be used alone or in various combinations.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A portable electronic device, comprising:

a housing having an opening;

an intermediate structure provided internal to the housing and having an opening there through; and an audio element, the audio element being secured to a first surface of the intermediate structure such that the audio element is acoustically coupled to the opening in the housing by way of the opening in the intermediate structure, wherein the intermediate structure comprises a flexible electrical substrate having an opening therethrough.

2. A portable electronic device as recited in claim 1, wherein the audio element is physically and electrically attached to the flexible electrical substrate.

3. A portable electronic device as recited in claim 2, wherein the portable electronic device comprises:

an audio chamber acoustically coupled between a second surface of the intermediate structure proximate the opening in the flexible electrical substrate and the opening in the housing.

4. A portable electronic device as recited in claim 1, wherein the portable electronic device comprises:

an audio chamber acoustically coupled between a second surface of the intermediate structure and the opening in the housing.

5. A portable electronic device as recited in claim 4, wherein the audio chamber comprises an audio boot having an upper boot portion and a lower boot portion.

6. A portable electronic device as recited in claim 5, wherein the upper boot portion is a more rigid than the lower boot portion, and the lower boot portion is more compliant than the upper boot portion.

7. A portable electronic device as recited in claim 1, wherein the portable electronic device comprises a mesh barrier assembly removably provided and recessed within the opening of the housing.

8. A portable electronic device as recited in claim 6, wherein the mesh barrier assembly comprises:

a mesh screen; and a support structure configured to support the mesh screen.

9. A portable electronic device as recited in claim 8, wherein the mesh screen is co-molded with the support structure.

10. A portable electronic device as recited in claim 1, wherein the audio element comprises a driver or a receiver.

11. A portable electronic device as recited in claim 1, wherein the audio element comprises a speaker driver assembly.

12. A portable electronic device as recited in claim 1, wherein the audio element comprises a microphone assembly.

13. A portable electronic device, comprising:

a housing having an opening;

a flexible electrical substrate having an opening there through; and an audio assembly, the audio assembly being secured to a first surface of the flexible electrical substrate such that the audio assembly is provided over the opening in the flexible electrical substrate.

14. A portable electronic device as recited in claim 13, wherein the housing is an outer housing for the portable electronic device, and wherein the housing includes a front cover having a thickness of less than 1 millimeter.

15. A portable electronic device as recited in claim 14, wherein the portable electronic device comprising:

an audio chamber acoustically coupled to a second surface of the flexible electrical substrate, and wherein the audio chamber extends from the second surface of the flexible electrical substrate to the opening in the housing.

16. A portable electronic device as recited in claim 15, wherein the audio chamber comprises an audio boot having an upper boot portion and a lower boot portion.

17. A portable electronic device as recited in claim 16, wherein the upper boot portion is a more rigid than the lower boot portion, and the lower boot portion is more compliant than the upper boot portion.

18. A portable electronic device as recited in claim 13, wherein the audio assembly is coupled to the first surface of the flexible electrical substrate through a foam layer.

19. A portable electronic device as recited in claim 13, wherein the audio chamber is secured to the second surface of the flexible electrical substrate by an adhesive.

20. A portable electronic device as recited in claim 13, wherein the audio chamber includes a rigid portion and a flexible portion, and wherein the second surface of the flexible electrical substrate couples to the rigid portion of the audio chamber.

21. A portable electronic device as recited in claim 20, wherein at least a portion of the flexible portion of the audio chamber is adjacent the opening in the housing.

22. A portable electronic device as recited in claim 13, wherein the audio assembly is an audio driver assembly, wherein a back volume for the audio driver assembly is contained using at least a portion of the first surface of the flexible substrate.

23. A portable electronic device as recited in claim 22, wherein the portable electronic device comprising:

an audio chamber acoustically coupled to a second surface of the flexible electrical substrate, wherein a front volume for the audio driver assembly is contained using at least a portion of the audio chamber.

24. A portable electronic device as recited in claim 13, wherein the portable electronic device comprises a mesh barrier assembly provided within the opening of the housing.

25. A portable electronic device as recited in claim 24, wherein the mesh barrier assembly comprises:

a mesh screen; and a support structure configured to support the mesh screen.

26. A portable electronic device as recited in claim 25, wherein the housing is an outer housing for the portable electronic device, and wherein the housing includes a front cover having a thickness of less than 1 millimeter.

27. A portable electronic device as recited in claim 26, wherein the mesh barrier assembly is provided within the opening of the housing such that the mesh screen is recessed within the opening by at least 20% of the thickness of the housing.

* * * * *